United States Patent [19]

Allen

[11] Patent Number: 4,572,704

[45] **Date of Patent: * Feb. 25, 1986**

[54] HIGH DENSITY CONCRETE PLACING AND FINISHING MACHINE

[75] Inventor: J. Dewayne Allen, Paragould, Ark.

[73] Assignee: Allen Engineering Corporation, Paragould, Ark.

[ * ] Notice: The portion of the term of this patent subsequent to Aug. 21, 2001 has been disclaimed.

[21] Appl. No.: 580,899

[22] Filed: Feb. 16, 1984

Related U.S. Application Data

[63] Continuation-in-part of Ser. No. 457,727, Jan. 13, 1983, Pat. No. 4,466,757.

[51] Int. Cl.[4] ..... E01C 19/29

[52] U.S. Cl. ..... 404/114; 404/119

[58] Field of Search ..... 404/113, 102, 101, 114–116, 404/118–120; 198/666, 661

[56] References Cited

U.S. PATENT DOCUMENTS

| | | | |
|---|---|---|---|
| 3,738,763 | 6/1973 | Glesmann | 404/119 |
| 4,015,734 | 4/1977 | Laidig | 198/661 |
| 4,068,970 | 1/1978 | Rowe | 404/101 |
| 4,314,773 | 2/1982 | Allen | 404/116 |
| 4,320,987 | 3/1982 | Rowe et al. | 404/115 |
| 4,386,695 | 6/1983 | Olson | 198/661 |

OTHER PUBLICATIONS

CMI Corporation, Bidwell Brochure p. 5, Jan. 1983.

*Primary Examiner*—James A. Leppink
*Assistant Examiner*—Matthew Smith
*Attorney, Agent, or Firm*—Cahill, Sutton & Thomas

[57] ABSTRACT

The present invention levels freshly poured concrete, internally vibrates a linear segment of that concrete and then moves forward and remixes a surcharged concrete layer to yield a more uniformly dense mass of concrete. The apparatus includes a bridge spanning the width of a plastic concrete surface and is suppported above and maintained substantially parallel to the plastic concrete surface. A small diameter auger is coupled to a carriage suspended beneath the bridge and is laterally translatable back and forth along the length of the bridge within the linear segment of concrete to level the irregular concrete surface to form a flat intermediate surface. An internal vibrator module is laterally translatable along the bridge for internally vibrating the plastic concrete to densify material within the linear segment into a surcharge layer. A large diameter auger is coupled to the carriage behind the small diameter auger to engage the concrete at a level below the intermediate surface and displace the surcharge layer forward and out of the linear segment as the bridge is translated forward with respect to the linear segment.

23 Claims, 15 Drawing Figures

LATERAL TRANSLATION
FORWARD TRANSLATION
10
12
14
16
20
24
26
28
30
32
36
38
54
62
64
74
76
2
3

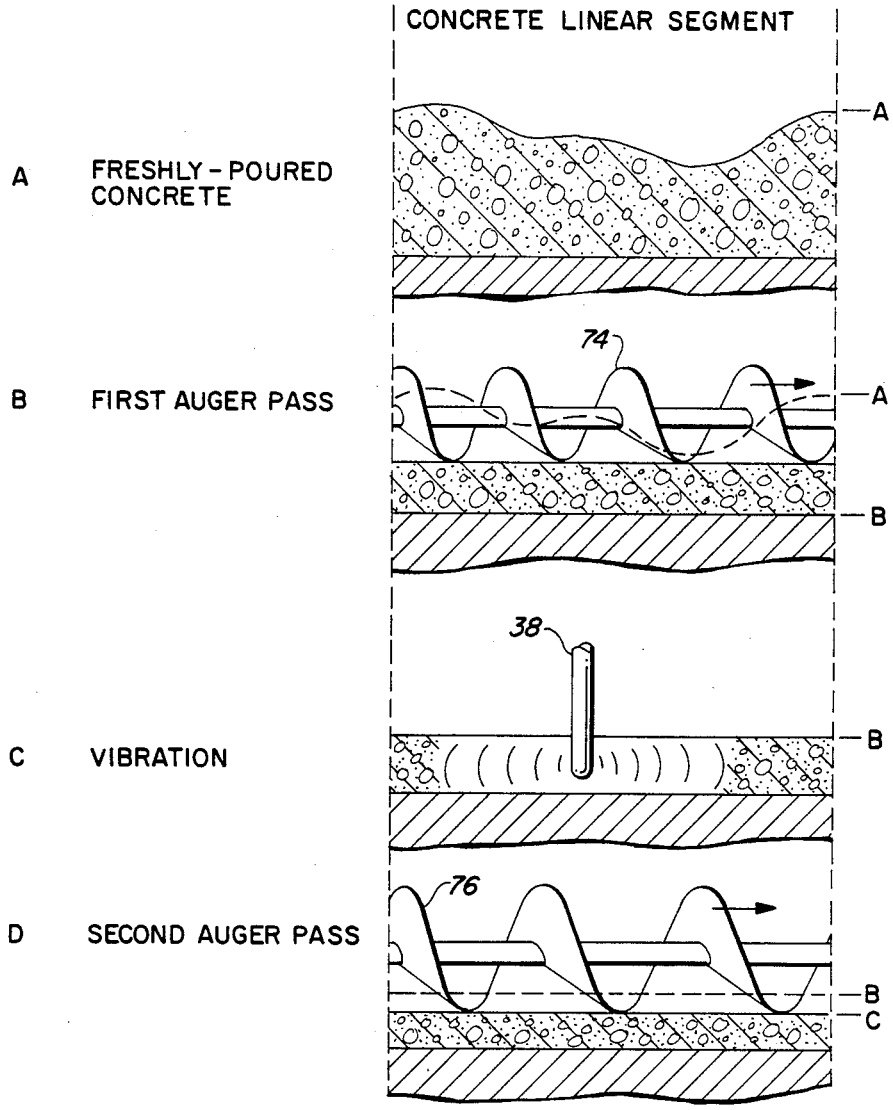
FIG. 11
FIG. 12
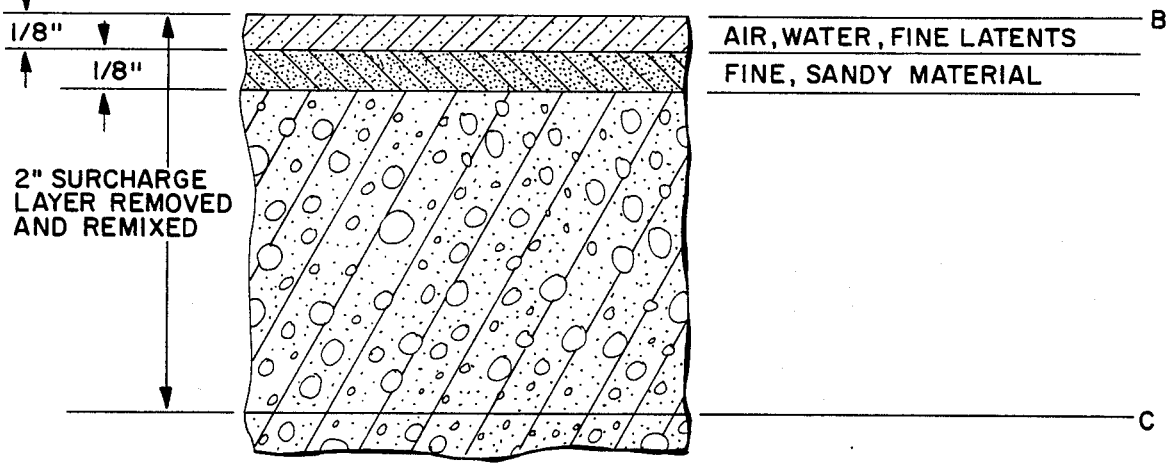

HIGH DENSITY CONCRETE PLACING AND FINISHING MACHINE

This application is a Continuation-in-Part Application of U.S. patent application Ser. No. 457,727, filed Jan. 13, 1983, now U.S. Pat. No. 4,466,757. The disclosure of U.S. Pat. No. 4,314,773 and the prior art references cited therein are relevant to the invention disclosed and claimed herein. The complete text of U.S. Pat. No. 4,314,773 is hereby incorporated by reference.

BACKGROUND OF THE INVENTION

1. Field of the Invention

The present invention relates to equipment for levelling and densifying plastic concrete, and more particularly, to equipment which both levels and internally vibrates plastic concrete.

2. Description of the Prior Art

Before applicant's invention of the apparatus disclosed herein, a person of ordinary skill in the art suggested the desirability of pouring plastic concrete in a thickness greater than ultimately required, internally vibrating that mass of concrete and subsequently removing the excess or surcharge layer of concrete to achieve a stronger and more durable concrete deck. Structure for accomplishing that objective was not disclosed.

The prior art discloses a wide variety of mechanical internal vibration devices for compacting and densifying plastic concrete. U.S. Pat. No. 4,128,359 (Cooper) discloses a self-propelled concrete vibrator apparatus which includes a plurality of hydraulically powered vibrators positioned at evenly spaced apart intervals across the full width of a support truss. This device includes a plurality of hydraulic rams which raise and lower the plurality of vibrator units into and out of a mass of wet concrete. A second group of horizontally oriented hydraulic rams is coupled to the plurality of vibrator units and laterally displaces the vibrator units between a first and a second position. This device includes an hydraulic pump driven by an internal combustion engine and a plurality of four drive units for longitudinally translating the entire structure along the length of the concrete to be vibrated.

U.S. Pat. No. 2,223,734 (Mall) discloses a concrete vibrator which is longitudinally translatable along the length of an area of wet concrete. This device includes a vibrator carriage to which an engine is mounted. This vibrating carriage is longitudinally translatable between a first and a second position and includes a centrally mounted shaft which permits the carriage to be pivoted and to thereby partially elevate the mechanically driven concrete vibrators with respect to the surface of the wet concrete. U.S. Pat. No. 2,248,103 (Mall) discloses an attachment for a screed which includes a laterally oriented frame having a plurality of evenly spaced apart vibrators. A hand actuated lever permits an operator to simultaneously raise or lower all of the vibrators with respect to the surface of the wet concrete. U.S. Pat. No. 1,945,145 (Gordon) discloses an apparatus for compacting and dewatering wet cement. The body of this device includes a hand operated lever which permits the entire device, including a plurality of vertically oriented fixed position vibrators and the vacuum chamber of the invention, to be raised or lowered with respect to the surface of the concrete. In the raised position, the entire device can be longitudinally translated with respect to the wet concrete.

U.S. Pat. No. 2,138,103 (Jorgensen) discloses a road paving machine which includes four motor driven vibrators which are mounted in laterally fixed positions to a longitudinally translatable carriage. A strike off bar is coupled to the carriage at a position behind the vibrator unit. A hand wheel in combination with a worm gear permits the vibrator assembly to be raised or lowered with respect to the surface of the concrete. When the vibrators are lowered into the surface of the concrete and the machine is advanced, the vibrators are deflected to the rear and are dragged through the surface of the wet concrete.

U.S. Pat. No. 2,382,096 (Pierce) discloses a paving machine having a plurality of vibrator units mounted at fixed positions laterally across the face of the device. The vibrators span the entire width of the wet concrete surface to be vibrated. This device includes a concrete screed and is hydraulically powered. The plurality of vibrators are pivoted about a point and inserted at an angle into the wet concrete in a manner which permits the vibrators to travel beneath the concrete screed.

U.S. Pat. No. 2,292,733 (Baily) discloses a concrete vibrating device including a plurality of vibrators mounted at a fixed position along the entire width of the device. The vibrators are flexibly coupled to the frame which permits them to be deflected to the rear of the frame as it advances through the concrete. U.S. Pat. No. 2,461,500 (Miller) discloses an apparatus for compating concrete slabs which includes a plurality of vibrator units mounted at fixed positions laterally across the device. Each vibrator is driven by a motor coupled to a flexible shaft. The vibrators trail behind and penetrate below the surface of the wet concrete as the device is advanced through the concrete.

U.S. Pat. No. 3,555,983 (Swisher) discloses a paving grout control device which includes vibrator units positioned at evenly spaced intervals laterally across the front of the device. This device includes a comb-like structure which is immersed at a point behind the vibrating units at a predetermined depth into the paving material. U.S. Pat. No. 2,148,214 (Mall) discloses a vibrating machine which includes an inverted "T"-shaped horizontally oriented vibrating tube which is immersed into the wet concrete. U.S. Pat. No. 2,233,833 (Jackson) discloses a related device having three horizontally oriented vibrating tubes which vibrate the wet concrete. A screed also forms a part of this device which serves to level the surface of the wet concrete. U.S. Pat. No. 3,113,494 (Barnes) discloses a machine for finishing concrete surfaces and includes a mechanically vibrated screed. This device is laterally translated by a pair of manually operated winches one of which is coupled to each end of the frame of this device.

The following U.S. patents disclose inventions relevant to applicant's invention: U.S. Pat. No. 1,747,555 (Pelton); U.S. Pat. No. 2,030,315 (Noble); U.S. Pat. No. 1,898,158 (Winkler); and U.S. Pat. No. 3,413,902 (Malan).

Many of the devices discussed above are hydraulically powered and include hydraulically driven vibrator devices. Hydraulically powered vibrating equipment is comparatively heavy since the hydraulic power source is typically mounted to the frame of the vibrating device. The weight of this hydraulically powered vibrating equipment is further increased since the frame itself must be heavier to support the substantial weight of the hydraulic power source.

Virtually all of the devices described above incorporate a plurality of vibrator units which are mounted at uniformly spaced apart intervals across the full span of the supporting frame. If any particular prior art concrete vibrating device can be modified to vibrate different widths of concrete surfaces, the width of the supporting frame must be modified and a corresponding number of vibrating units must either be added to or subtracted from the device. This particular requirement not only increases the weight of the equipment which has been adapted to vibrate wide concrete surfaces, but also substantially increases the cost of a widened device since each vibrator unit is a highly specialized, high cost piece of equipment. The addition of vibrator units to a widened device also requires that the hydraulic or mechanical power unit produce an increased amount of power to drive the added vibrator units.

SUMMARY OF THE INVENTION

It is therefore a primary object of the present invention to provide a high density concrete placing and finishing machine which has the capability of initially levelling the irregular upper surface of freshly poured plastic concrete, internally vibrating and compacting the plastic concrete, and removing and remixing a surcharge layer from the internally vibrated concrete surface.

Another object of the present invention is to provide a high density concrete placing and finishing machine which includes a laterally translatable internal vibrator table and a laterally translatable carriage including levelling means and an auger positioned behind the levelling means for forming, internally vibrating and removing a surcharged layer from the plastic concrete to form a more uniform concrete deck.

Yet another object of the present invention is to provide a high density concrete placing and finishing machine which can be controlled by a single operator from a single position to rapidly and uniformly place and partially finish plastic concrete.

Breifly stated, and in accord with one embodiment of the invention, a high density concrete placing and finishing machine includes bridge means spanning the width of a plastic concrete surface and support means for maintaining the bridge means in a plane substantially parallel to the plastic concrete surface. Levelling means is coupled to and laterally translatable along the length of the bridge means within a linear segment of the concrete surface for levelling the irregular concrete surface to form a flat intermediate surface. Vibrating means is coupled to the bridge means for internally vibrating the linear segment to densify the concrete and to elevate low density material within linear segment into a surcharge layer. An auger is coupled to and laterally translatable along the length of the bridge means within the linear segment to engage the concrete at a level below the intermediate surface to displace the surcharge layer forward and out of the linear segment.

DESCRIPTION OF THE INVENTION

The invention is pointed out with particularity in the appended claims. However, other objects and advantages together with the operation of the invention may be better understood by reference to the following detailed description taken in connection with the following illustrations, wherein:

FIGS. 11A–D represent a sequential depiction of the operation of the present invention on a linear segment of the plastic concrete surface.

FIG. 12 is a cross sectional view of the concrete surcharge layer formed, removed and remixed by the present invention.

DESCRIPTION OF THE PREFERRED EMBODIMENT

In order to better illustrate the advantages of the invention and its contributions of the art, a preferred hardware embodiment of the invention will now be described in some detail.

Figures 1, 2:
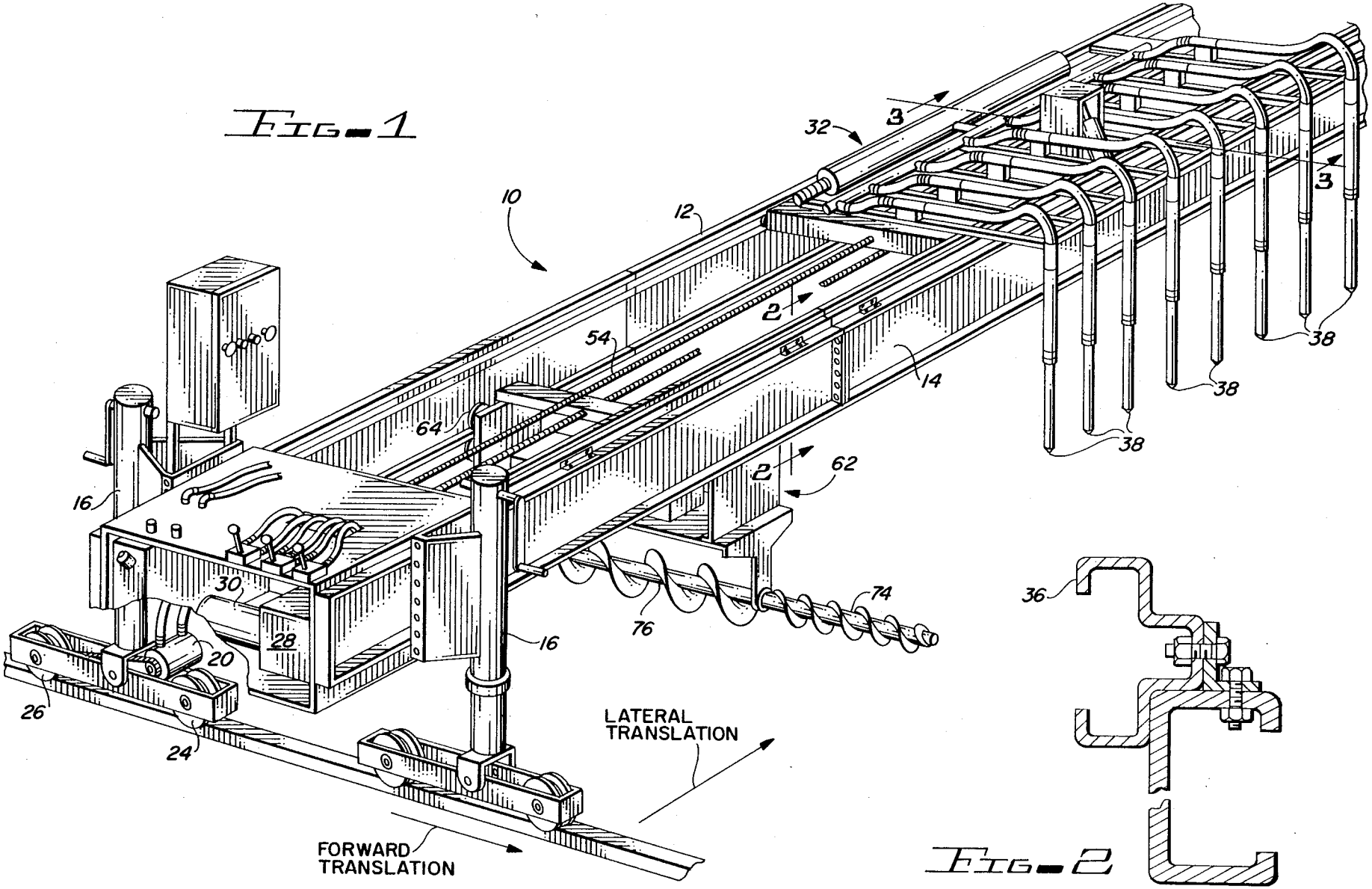
FIG. 1 is a perspective view of the high density concrete placing and finishing machine of the present invention.
FIG. 2 is a sectional view of the high density concrete placing and finishing machine depicted in FIG. 1, taken along section line 2—2.
Figure 4:
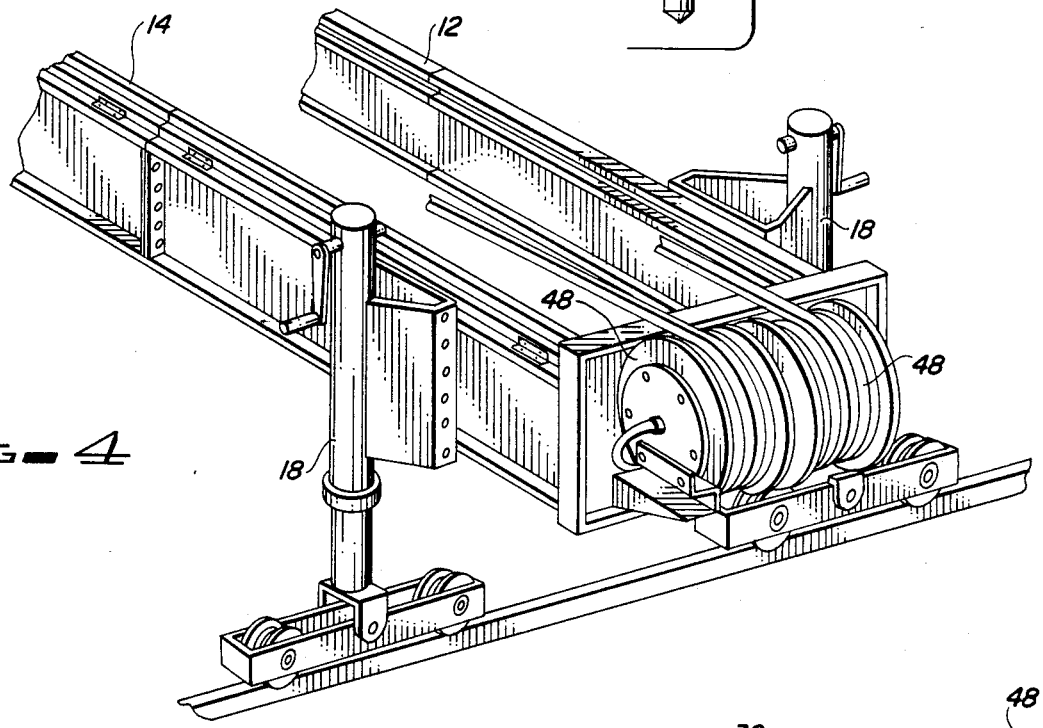
FIG. 4 is a partially cutaway perspective view of the opposite end of the bridge which was omitted from the FIG. 1 depiction.

Referring now to FIG. 1, the bridge 10 of the present invention is fabricated from a pair of spaced apart, parallel oriented support members 12 and 14. Support means in the form of paired roller assemblies 16 and 18 are coupled to the respective ends of support members 12 and 14. FIG. 4 illustrates that roller assemblies 18 coupled to the far end of bridge 10 are secured to support members 12 and 14 by roller and track assemblies to permit relative lateral displacement between bridge 10 and roller assemblies 18 thereby accommodating different concrete form spacing or variations in form spacing along the length of an area of plastic concrete. This lateral adjustment provisions is typically only required on one end of bridge 10.

Figure 6:
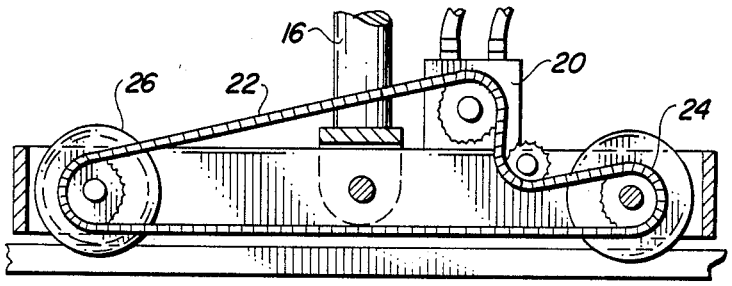
FIG. 6 is a partially cutaway illustration of the roller unit drive system of the present invention.
Figure 9:
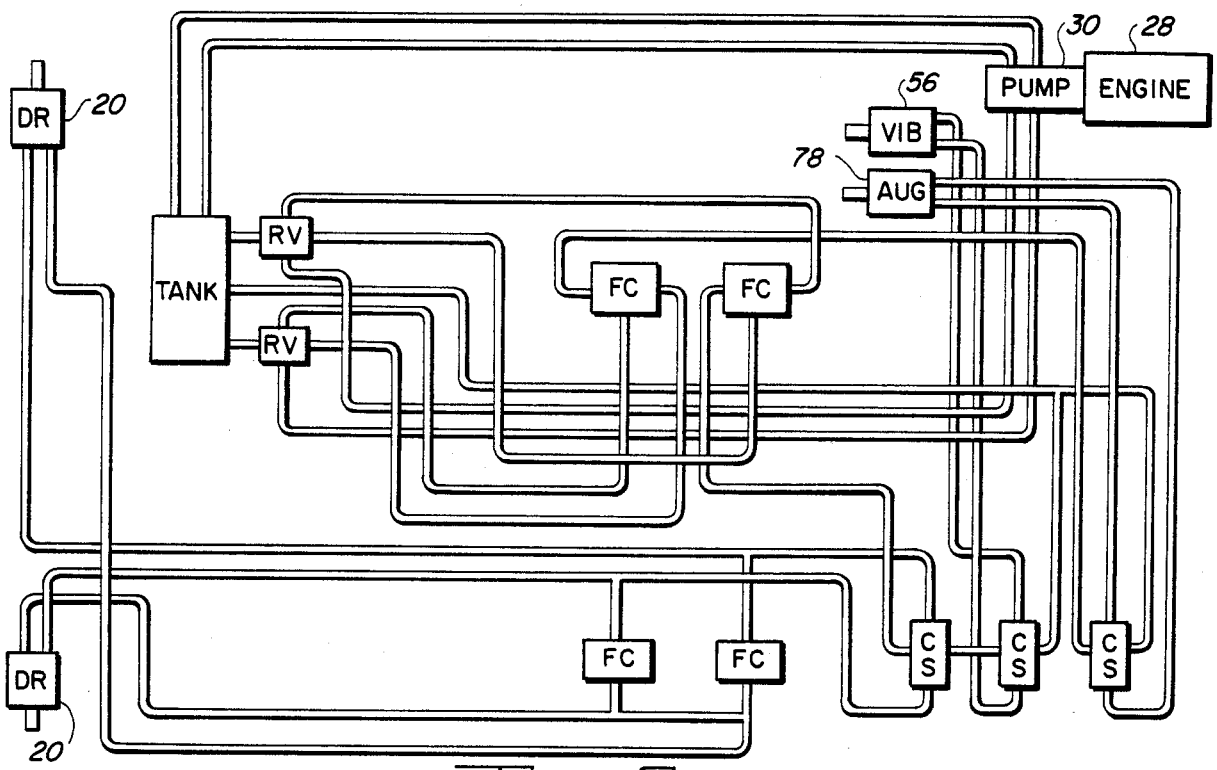
FIG. 9 is a hydraulic system schematic diagram illustrating the hydraulic system coupled to the bridge of the high density concrete placer.

Referring now to FIGS. 1 and 6, the hydraulic drive system for roller assemblies 16 and 18 is depicted. The output shaft of a hydraulic motor 20 rotates a toothed wheel which engages a chain 22 for driving the forward and rear roller assemblies 24 and 26 of the rear truck of roller assemblies 16 and 18. The FIG. 9 hydraulic circuit diagram indicates that a small internal combusion engine 28 drives a double hydraulic pump 30, one-half of which provides a source of pressurized hydraulic fluid to hydraulic motors 20. In FIG. 9, the following abbreviations are used:

RV: pressure release valves

FC: flow control valves

CS: flow switching valves

By adjusting the appropriate flow control valves, the operator can control the rate of rotation of hydraulic motors 20 and the rate of forward translation of bridge 10 with respect to the plastic concrete surface.

Figure 3:
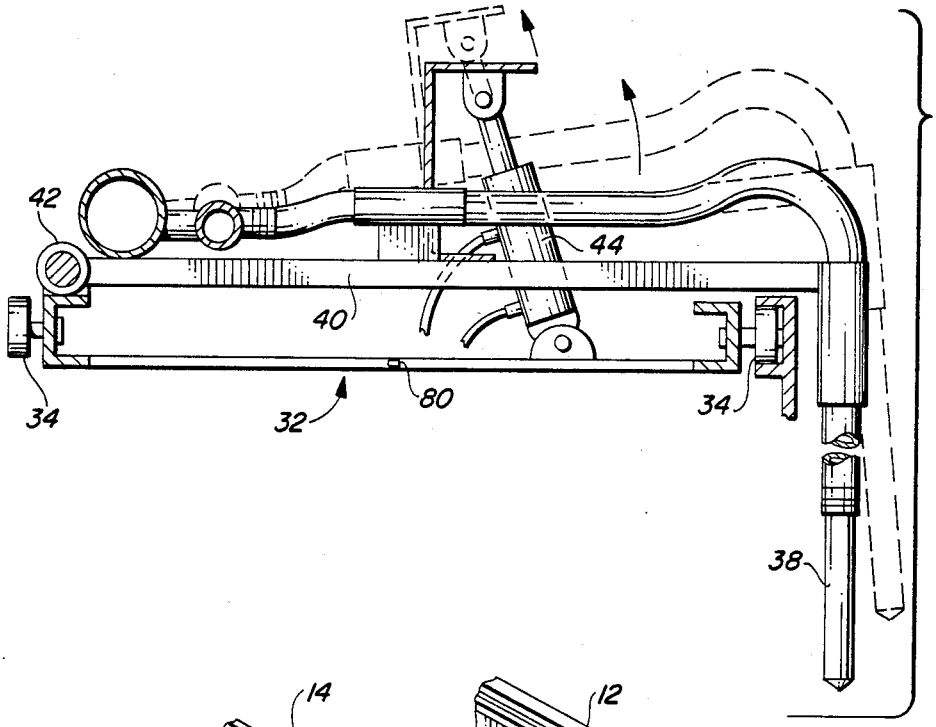
FIG. 3 is a sectional view of the high density concrete placing and finishing machine depicted in FIG. 1, taken along section line 3—3. The dotted line depiction illustrates the internal vibrator mechanisms in the elevated position.

Referring now to FIGS. 1, 2 and 3, a laterally translatable table 32 is coupled to bridge 10 by a plurality of rollers 34 which are positioned within a pair of channels 36. A plurality of pneumatically powered internal vibrator units 38 are coupled to a frame 40 which is pivotally coupled to table 32 by hinge 42. A pneumatically actuated cylinder 44 displaces vibrator units 38 between the lowered position depicted in FIG. 3 by solid lines and the elevated position depicted in FIG. 3 by dashed lines.

Figure 10:
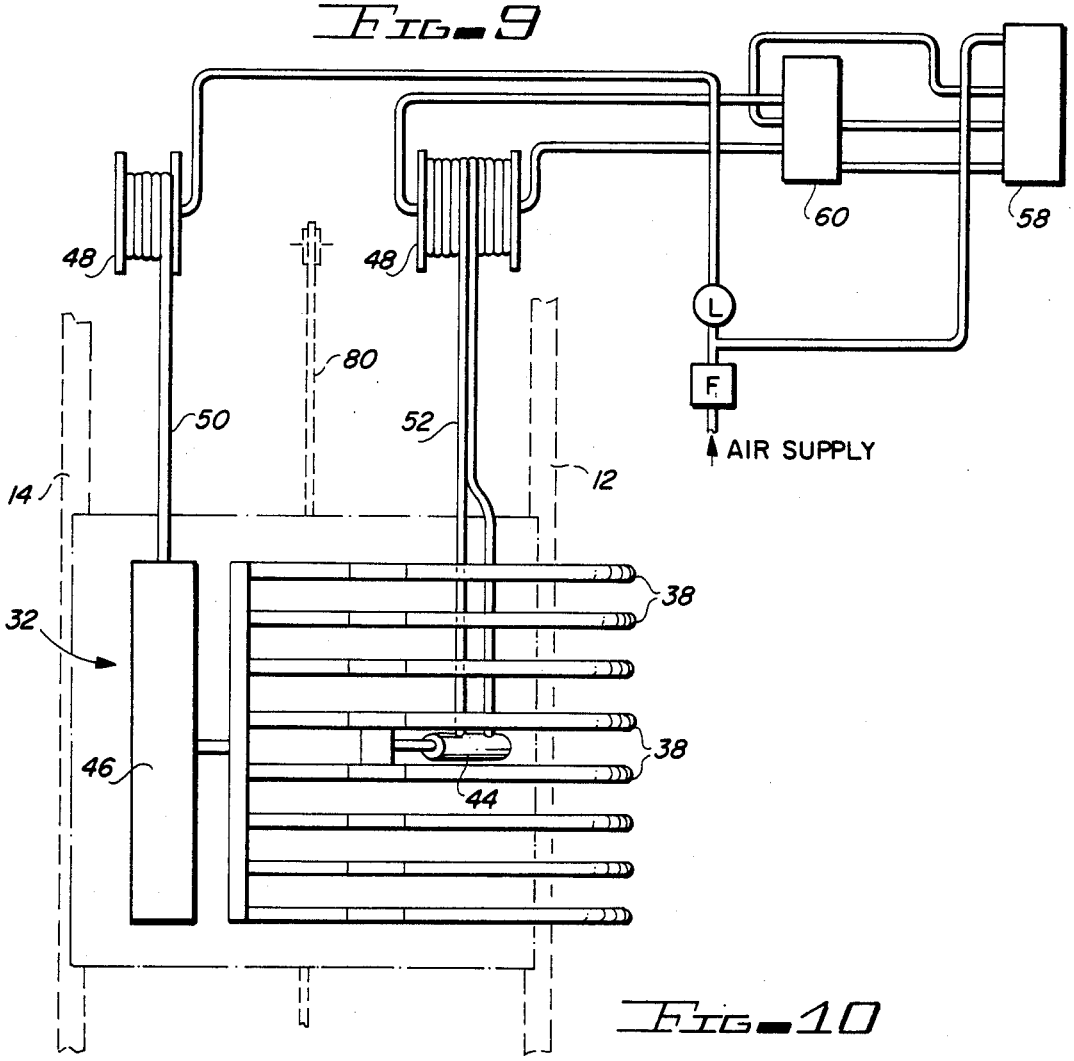
FIG. 10 is a diagram of the pneumatically powered internal vibrator system of the present invention.

Referring now to FIGS. 4 and 10, an external pneumatic air supply for actuating the pneumatic vibrators 38 and air cylinder 44 is coupled to bridge 10. A surge tank 46 assists in maintaining a uniform pressure to the pneumatically operated elements of the present invention.

A pair of spring biased hose reels 48 maintain an appropriate biasing force on air hoses 50 and 52 as table 32 is laterally translated back and forth across bridge 10.

Figure 5:
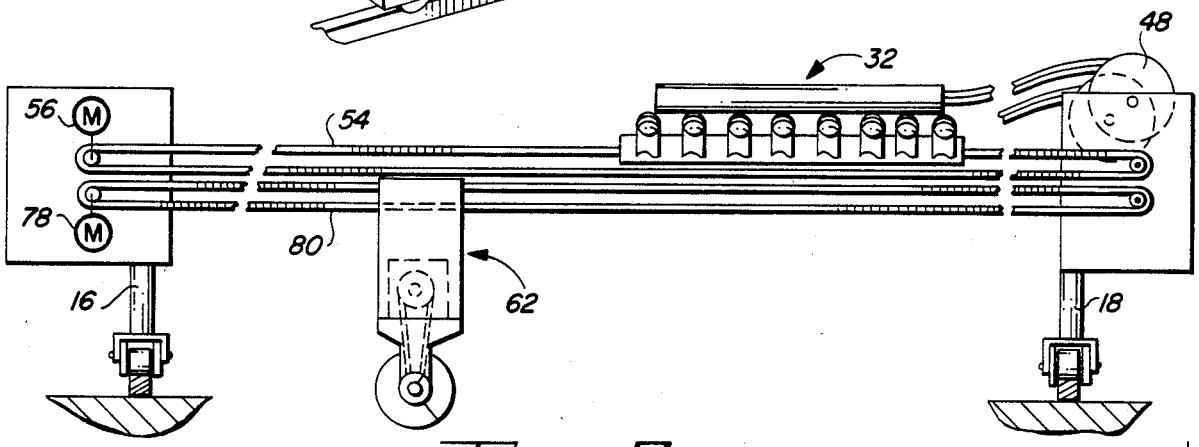
FIG. 5 is a simplified, front-end view of the high density concrete placing and finishing machine of the present invention particularly illustrating the manner in which a first chain laterally translates the internal vibrator table and a second chain laterally translates the auger carriage.

A continuous length of chain 54 is coupled to each side of table 32 and driven in either a forward or reverse direction by hydraulic motor 56 as indicated in FIGS. 5 and 9. The operator of the high density concrete placing and finishing machine can control the speed and direction of rotation of motor 56 to control the back and forth translation of table 32. A pneumatic logic control box 58 and pilot valve assembly 60 are depicted in FIG. 10 and serve the purpose of controlling air cylinder 44 to control the pneumatic vibrator entry rate into the plastic concrete surface, the vibrator exit rate from the plastic concrete surface and the duration of internal vibration applied to the plastic concrete. Automatic control devices of this type are available from the Aro Company and designated by part no. 49000-095. Automatic control of the internal vibrators has been utilized to obtain maximum uniformity during concrete placement operations.

Figure 7:
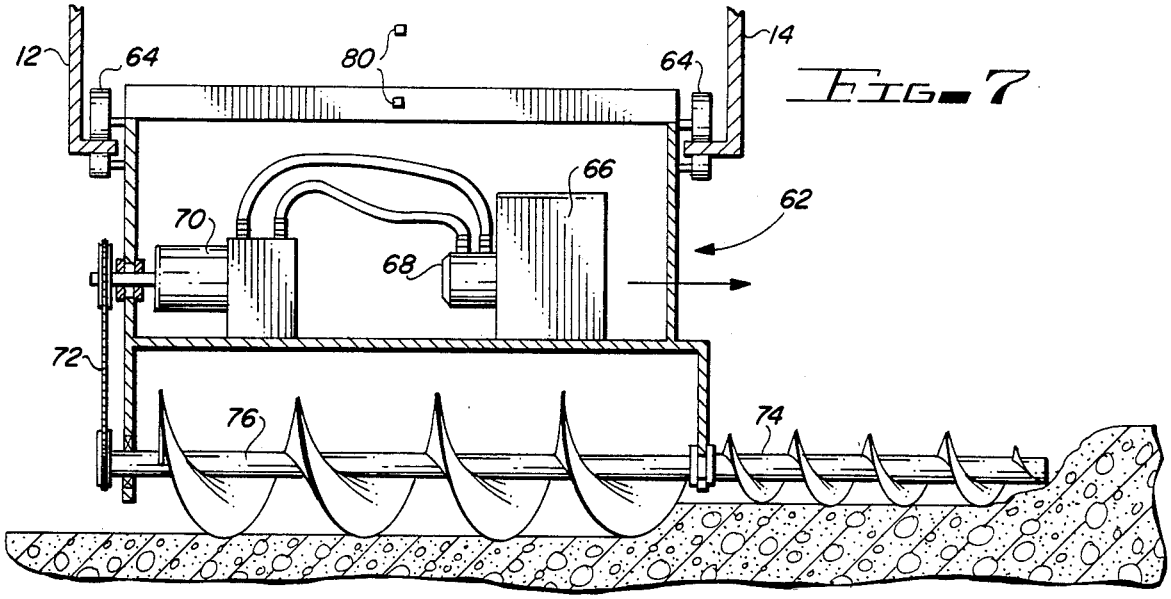
FIG. 7 is a cross-sectional view of the high density concrete placing and finishing machine of the present invention particularly illustrating the aligned large and small diameter augers which form and then eliminate a surcharge level of concrete.
Figure 8:
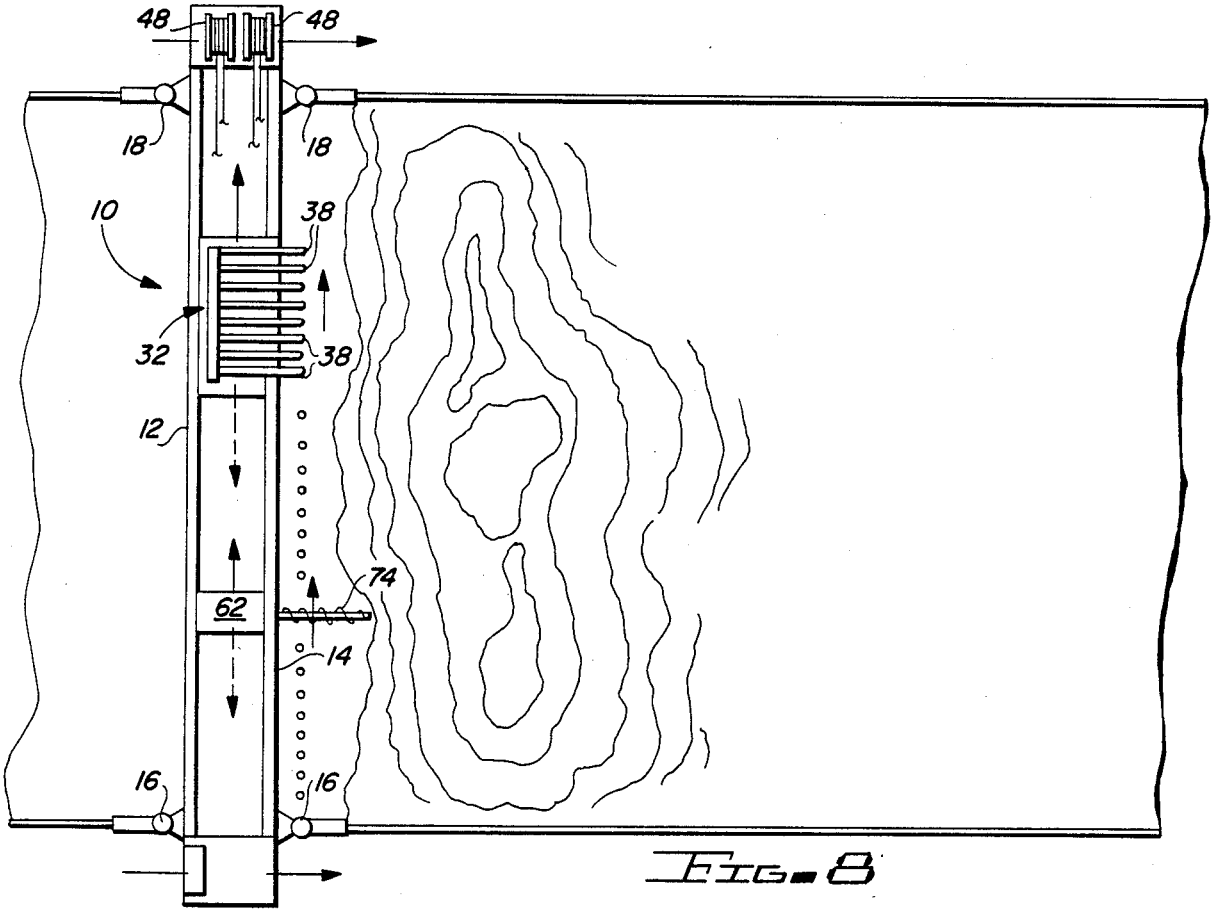
FIG. 8 is a simplified view from above illustrating the manner in which the high density concrete placing and finishing machine of the present invention is sequentially translated along the length of an area of plastic concrete.

Referring now to FIGS. 1, 5 and 7, the auger assembly of the present invention will now be described in some detail. An auger carriage assembly 62 is translatably coupled to the lower channel of bridge support members 12 and 14 by a plurality of rollers 64. A small internal combustion engine 66 is coupled to auger carriage 62 and drives hydraulic pump 58 which produces a source of high pressure hydraulic fluid for operating hydraulic motor 70. The output shaft of motor 70 is coupled to a chain drive assembly 72 to rotate concrete levelling means in the form of a small diameter auger 74 and a large diameter auger 76. Hydraulic motor 70 is actuated by an on/off valve coupled to auger carriage 62. The operating speed of motor 70 is controlled by a flow control valve on carriage 62.

FIG. 5 illustrates that hydraulic motor 78 drives a chain 80 which is coupled to auger carriage 62. The operator of the high density concrete placing and finishing machine has access to a flow control valve and flow reversing valve which controls the speed and translation direction of auger carriage 62. The hydraulic schematic diagram depicted in FIG. 9 illustrates the manner in which the various hydraulic components of this system are interconnected.

In the preferred embodiment of the invention, auger 76 is fabricated with a four inch diameter while auger 74 is fabricated with a two inch diameter. Because these two augers are connected to a common shaft, the lower elevation differential between the lower extension of each auger blade is equal to two inches.

The operation of the present invention will now be discussed by reference to FIGS. 7, 8, 11 and 12. The high density placing and finishing machine of the present invention is initially placed on side rails adjacent to the area of plastic concrete to be operated upon. The plastic concrete is typically deposited with an irregular surface onto a bridge deck or other surface by a two cubic foot concrete bucket or from an equivalent source.

The vertical elevation of roller assemblies 16 and 18 is initially adjusted so that the blade of auger 74 engages the irregular plastic concrete surface as depicted in FIG. 11(*a*) at approximately the position depicted in FIG. 11(*b*). Air cylinder 44 is actuated to place the vibrator table in the elevated position and hydraulic motor 56 is actuated to displace the air vibrator table to the far end of bridge 10.

The machine operator then actuates hydraulic motor 70 to commence rotational motion of augers 74 and 76 followed by actuation of hydraulic motor 78 to commence the back and forth translations of auger carriage 62 with respect to bridge 10. Approximately four passes of auger carriage 62 are required to level the upper surface of the plastic concrete sufficiently to to commence internal vibration operations. During these four passes, hydraulic motors 20 on roller assemblies 16 and 18 are actuated to drive bridge 10 forward at a rate of approximately one foot per minute. Upon completion of the four passes of auger carriage 62 across the plastic concrete surface, the concrete placing and finishing machine should have advanced approximately one foot. This one foot forward translation defines a single linear segment which is subsequently internally vibrated.

Upon completion of the lateral translations of auger carriage 62, and formation of the linear segment of concrete, pneumatic vibrator table 32 is actuated to internally vibrate the entire length of the linear segment in width-wise segments equal to the table width. In the preferred embodiment of the present invention, one and seven-eighths inch internal vibrators are utilized having an effective radius of action of approximately 18 inches. The 18 inch radius of vibration effectively vibrates concrete outside of the one foot wide linear segment to provide overlap between sequential passes of the device over adjacent linear segments.

The machine operator initiates the internal vibration operations by actuating pneumatic control box 58. This device automatically controls air cylinder 44 to cause the internal vibrators to penetrate into the concrete at a predetermined rate, to internally vibrate the concrete for a determined length of time, and to retract the internal vibrators from the plastic concrete at a predetermined rate. When the internal vibration operation of a widthwise segment of concrete has been completed, the operator actuates vibrator table drive motor 56 to reposition vibrator table 32 over an adjacent widthwise segment of plastic concrete where the automatic internal vibration procedure is repeated. This series of operations is repeated until the entire length of a linear segment of concrete has been internally vibrated. At that point, the roller assembly hydraulic motors are reactuated and the machine is displaced at a forward rate of approximately one foot per minute while auger carriage 62 is repeatedly laterally displaced with respect to bridge 10.

The objective of the procedure described above can be explained by reference to FIG. 12. The internal vibration of plastic concrete causes air, water and fine latents to form an upper layer on the plastic concrete while fine sandy material forms an adjacent layer immediately below that first layer. Each of these two layers is approximately one-eighth of an inch in depth. At some distance below these two layers, the concrete assumes a substantially uniform density. The non-uniformity of the upper layer of plastic concrete following internal vibration operations produces a cured concrete material having a substantially weaker outer layer which is subject to rapid wear and fast deterioration.

The present invention eliminates this undesirable layer and produces a totally uniform concrete deck by initially forming an excessively deep thickness of concrete, by subsequently internally vibrating that excessively thick layer and by sequentially removing and remixing that excess or surcharge layer of concrete. This process is best illustrated by the sequentially related diagrams A–D of FIG. 11.

FIG. 11A illustrates the highly irregular surface of freshly poured plastic concrete. FIG. 11B illustrates that multiple passes of levelling means in the form of a plow or auger blade 74 forms a comparatively level plastic concrete surface indicated by reference letter "B." FIG. 11C illustrates that internal vibrator units 38 penetrate into the levelled plastic concrete surface to internally vibrate the concrete. FIG. 11D illustrates that as bridge 10 is translated forward into the previously internally vibrated area of concrete lying within a give linear segment, the surcharge layer of concrete lying between the area designated by reference letters B–C is engaged by the blades of large diameter 76. The auger blade displaces the surcharge layer B–C forward to create a new, lower level concrete surface designated by reference letter C. The approximately two inch thick surcharge layer B–C containing the undesirable materials depicted in FIG. 12 is remixed by auger 76 and displaced forward into an adjacent linear segment which is simultaneously being levelled and mixed by smaller diameter auger 74.

The unique interaction of spaced apart, different diameter auger blades 74 and 76 coupled with an internal vibration step essentially eliminates the non-uniform concrete layer depicted in FIG. 12 and creates a concrete slab having uniform strength and density and a substantially greater durability than cured concrete produced according to prior art methods.

After the high density concrete placer described above has completed its operations on a plastic concrete surface, conventional commercially available concrete finishing equipment such as an Allen Engineering HD Screed is used to complete concrete finishing operations.

It will be apparent to those skilled in the art that the disclosed high density concrete placing and finishing machine may be modified in numerous ways and may assume many embodiments other than the preferred forms specifically set out and described above. For example, levelling means 74 has been described as having the configuration of a smaller diameter auger coupled to a common shaft incorporating a larger diameter auger. Levelling means 74 could also take the form of a plow or blade mounted perpendicular to the direction of travel of auger carriage 62 or inclined at an angle thereto to displace concrete either laterally or forward as the levelling operation proceeds. Similarly, auger carriage 62 could house levelling means 74 and auger 76 in an adjacent or side by side relationship and the required forward to rear effective spacing could be provided by displacing bridge 10 back and forth with respect to a single linear segment of concrete. Internal vibration could also be provided by a plurality of internal vibrator mechanisms spaced at uniform intervals across the entire length of bridge 10. The utilization of a laterally displaceable vibrator table of the type disclosed in FIG. 1 reduces the overall weight of the device, requires a smaller supply of compressed air and reduces the overall system costs. Alternatively, the internal vibration operation could be accomplished by a second individual utilizing a single internal vibrator mechanism to manually accomplish the internal vibration procedure at an appropriate time. The internal vibration mechanism disclosed in FIG. 1 has been attached to bridge 10 primarily to eliminate the requirement for a second laborer and to accomplish the concrete finishing operations at a more rapid rate. The essence of applicant's invention is depicted in FIG. 11 and is not inherently limited to any particular structure of the type depicted in FIG. 1. Numerous other combinations of equipment, used separately or in combination, could readily be assembled to practice applicant's invention as described. In addition, the internal vibration operation could be performed before auger 74 intially levels a section of concrete. Accordingly, it is intended by the appended claims to cover all such modifications of the invention which fall within the true spirit and scope of the invention.

I claim:

1. Apparatus for partially finishing an area of plastic concrete having an irregular upper surface, comprising:

a. bridge means spanning the width of the plastic concrete surface;

b. support means for maintaining said bridge means in a plane substantially parallel to the plastic concrete surface;

c. means for translating said bridge means along the length of said concrete surface;

d. levelling means coupled to and laterally translatable along the length of said bridge means within a linear segment of said plastic concrete for levelling the irregular upper surface of said concrete to form a flat intermediate surface;

e. vibrating means coupled to said bridge means for internally vibrating said linear segment to densify said concrete and to elevate low density material within said linear segment into a surcharge layer; and f. first auger means coupled to and laterally transluatable along the length of said bridge means within said linear segment for engaging said plastic concrete at a level below said flat intermediate surface to thereby remove and displace said surcharge layer of concrete forward and out of said linear segment, wherein said levelling means and said first auger means are coupled to a carriage laterally translatable with respect to said bridge means.

2. The apparatus of claim 1 wherein said levelling means includes second auger means.

3. The apparatus of claim 2 wherein the diameter of said first auger means is greater than the diameter of said second auger means.

4. The apparatus of claim 3 wherein said vibrating means includes a plurality of spaced apart vibrators displaceable between an elevated position wherein said vibrators are spaced above said concrete surface and an immersed position wherein said vibrators penetrate into and impart vibratory motion into the plastic concrete.

5. The apparatus of claim 4 wherein said vibrators are coupled to a table laterally translatable with respect to said bridge means for vibrating a segmented width of said concrete.

6. The apparatus of claim 5 further including means coupled to said table for incrementally laterally translating said table along said bridge means.

7. The apparatus of claim 6 wherein said vibrating means further includes means for displacing said vibrators between the elevated and immersed positions.

8. The apparatus of claim 1 wherein said levelling means is coupled to said carriage at a position in front of said first auger means.

9. The apparatus of claim 8 wherein said leveling means includes second auger means having a diameter less than the diameter of said first auger means.

10. The apparatus of claim 9 wherein said first and second auger means are coupled to a common shaft.

11. The apparatus of claim 1 wherein said vibrating means is pneumatically powered.

12. The apparatus of claim 1 further including means coupled to said carriage for rotating said first auger means.

13. The apparatus of claim 12 wherein said rotating means further includes a hydraulic drive system.

14. The apparatus of claim 1 further including means for translating said carriage with respect to said bridge means.

15. The apparatus of claim 1 wherein said support means further includes first and second roller assemblies coupled to the first and second ends of said bridge means.

16. The apparatus of claim 15 wherein said first and second roller assemblies each include means for adjusting the spacing between said bridge means and said plastic concrete surface.

17. Apparatus for partially finishing an area of plastic concrete having an irregular upper surface, comprising:

a. bridge means spanning the width of the plastic concrete surface and including first and second ends;

b. support means for maintaining said bridge means in a plane substantially parallel to the plastic concrete surface;

c. means for translating said bridge means in a forward direction along the length of said concrete surface;

d. vibrating means coupled to said bridge means for internally vibrating a linear segment of said concrete to densify said concrete and to elevate low density material within said linear segment into a surcharge layer; and e. a carriage coupled to and laterally translatable along said bridge means including i. second auger means for levelling the linear segment of said irregular surface to form a flat intermediate surface;

ii. first auger means positioned behind said second auger means and coupled to a common shaft for engaging said concrete within said linear segment as said bridge means is translated in a forward direction.

18. The apparatus of claim 17 wherein the diameter of said second auger means is less than the diameter of said first auger means.

19. A method for partially finishing an area of plastic concrete having an irregular upper surface, comprising the steps of:

a. supporting bridge means above and substantially parallel to the plastic concrete surface;

b. levelling a linear segment of said concrete surface to form a flat intermediate surface by laterally translating first levelling means across said bridge means, wherein said levelling means is maintained at a first reference elevation below said bridge means;

c. internally vibrating the concrete within said linear segment to densify said concrete and to elevate low density material within said linear segement into a surcharge layer; and d. engaging said concrete within said linear segment at a level below said intermediate surface with second levelling means maintained at a second reference elevation below said bridge means and said first reference elevation and displacing said surcharge layer forward and out of said linear segment to permit said surcharge layer to be remixed with said plastic concrete by said first levelling means.

20. The method of claim 19 wherein the linear segment levelling, surcharge displacing steps are accomplished by auger means coupled to a carriage laterally translatable with respect to said bridge means.

21. The method of claim 20 wherein said levelling step is performed by auger means coupled to said carriage.

22. The method of claim 21 wherein said carriage is laterally translated across said bridge within said linear segment after the internal vibration of said linear segment has been completed.

23. The method of claim 19 wherein said vibrating step is accomplished before said levelling step.

* * * * *